US005738289A

United States Patent [19]

Tagawa

[11] Patent Number: 5,738,289

[45] **Date of Patent: *Apr. 14, 1998**

[54] CRUSHER

[75] Inventor: Itsuo Tagawa, Tokyo, Japan

[73] Assignee: Sangojuuki Co., Ltd., Tokyo, Japan

[ * ] Notice: The term of this patent shall not extend beyond the expiration date of Pat. No. 5,636,802.

[21] Appl. No.: 718,391

[22] PCT Filed: Jan. 26, 1996

[86] PCT No.: PCT/JP96/00150

§ 371 Date: Oct. 1, 1996

§ 102(e) Date: Oct. 1, 1996

[87] PCT Pub. No.: WO96/23944

PCT Pub. Date: Aug. 8, 1996

[30] Foreign Application Priority Data

Feb. 1, 1995 [JP] Japan ..... 7-034731

[51] Int. Cl.[6] ..... B02C 1/06

[52] U.S. Cl. ..... 241/266; 241/101.73

[58] Field of Search ..... 30/134; 241/266, 241/101.73

[56] References Cited

U.S. PATENT DOCUMENTS 4,890,798 1/1990 Tagawa et al. .
5,636,802 6/1997 Tagawa ..... 241/266

FOREIGN PATENT DOCUMENTS 453 773 3/1991 European Pat. Off. .
2 648 365 6/1990 France .
36 18 191 12/1987 Germany .
92 10 765 11/1992 Germany .
59-187976 10/1984 Japan .
62-6068 1/1987 Japan .
63-40061 2/1988 Japan .
63-184667 7/1988 Japan .
4-347270 12/1992 Japan .

*Primary Examiner*—Mark Rosenbaum
*Attorney, Agent, or Firm*—Lowe, Price, LeBlanc & Becker

[57] ABSTRACT

A crusher capable of effectively crushing a building structure, shearing iron reinforcing rods, etc., smashing the crushed scraps into pieces, and collecting and carrying an elongated object. A pair of arms (2*a*, 2*b*) are driven to open and close for crushing and shearing the object. A front end of each of the pair of arms is divided into a plurality of fingers to which claws (7*a*, 7*a'*, 7*b*) are respectively attached. Only the central claw (7*a'*) is inwardly directed by a greater angle as compared with the other claws (7*a*, 7*b*). Each arms has a shearing blade (10*a*, 10*b*) for shearing an iron reinforcing rod, an iron frame, etc. in the vicinity of the pivoted portion, and also through holes (11) in the central portion. Weight of the arms (2*a*, 2*b*) and an arm support (3) are balanced with respect to the central axis of rotation of the arm support (3). The central claw (7*a'*) gives a concentrated stress to the building structure to cause cracks when the arms (2*a*, 2*b*) are closed, thereafter the object is squashed out by all of the claws (7*a*, 7*a'*, 7*b*). Concrete scraps are smashed by the central portions of the arms and flow out from the through holes.

6 Claims, 5 Drawing Sheets

CRUSHER

TECHNICAL FIELD

The present invention relates to an improvement of a crusher for use in crushing a wooden house, a concrete building, etc. by attaching it to a construction machine, such as a power shovel.

BACKGROUND ART

There is known a crusher for crushing a building structure by a pair of arms driven to open and close by a hydraulic cylinder.

This type of crusher generally comprises squashing blades at front ends of the pair of opening and closing arms for clamping and crushing an iron-reinforced concrete building structure, and shearing blades in the vicinity of the pivoted central portions of the arms for cutting an iron reinforcing rod, an iron frame, etc. which are exposed by squashing the concrete building structure, as disclosed :in Japanese Patent Laid-Open Publication No. Sho 63-40061, for example.

However, since scraps obtained by merely destroying the building structure are too large to be carried and cannot be recycled, they should be broken or smashed into smaller pieces. If the crusher as described in Japanese Patent Laid-Open Publication No. Sho 63-40061 is used in smashing the scraps, there is a problem that the operating efficiency is poor.

For solving the problem, Japanese Patent Laid-Open Publications Nos. Sho 59-187976 and Hei 4-347270 proposed and known a crusher. In the crusher, a number of through holes are provided on the central region between the pivoted portion and the front end of each of the opening and closing arms, and a projection or a roller is disposed on the central region of one arm for scooping the scraps of the building structure. The arms are opened to scoop the scraps resulted from the squashing of the building structure, and large pieces of the scooped scraps are smashed into small pieces by closing the arms to throw out from the through holes.

Crushing operation of a wooden house or a concrete building structure includes the following works:

(1) destroying the wooden or concrete columns, beams, walls and base;

(2) smashing the concrete scraps into pieces;

(3) cutting the wooden beams and columns or the iron reinforcing rods and iron frames;

(4) collecting the pieces of the wooden beams and columns produced by destroying the building structure or the cut iron reinforcing rods and iron frames; and (5) carrying the wooden pieces or the cut iron reinforcing rods and frames as well as the concrete pieces onto the bed of a truck.

Changing an attachment suitable for the respective work to a construction machine, such as a power shovel, would be time-consuming and hence inefficient due to the work of exchanging one attachment with another. Also, using many attachments is not economical. Using the crusher as disclosed in Japanese Patent Laid-Open Publication No. Sho 63-40061, which is suitable for destroying a building structure, the above-mentioned work (1) can be performed, however, the above-mentioned works (2), (4) and (5) cannot be performed or may be performed with very low inefficiency. On the other hand, with the crusher as described in Japanese Patent Laid-Open Publications Nos. Sho 59-187976 and Hei 4-347270, which is suitable for smashing the scraps of the destroyed building structure into small pieces, the most basic work (1) cannot be satisfactorily accomplished for lack of power, although the works (2)–(5) can be performed.

Likewise, the attachments suitable for the respective works (3)–(5) are known, but the works (1) and (2) cannot be performed.

Further, in performing these works, in order to crush or grasp a horizontally extending wooden or concrete building structure, such as a beam or a ceiling surface, the opening and closing direction of the arms of the crusher must be vertical. In order to crush a vertical building structure such as a column or a wall, the opening and closing direction of the arms must be kept horizontal. Thus, it is necessary to change the opening and closing direction of the arms in accordance with the state (posture) of an object to be crushed, and it is therefore preferable that the opening and closing direction of the arms can be selected simply. In the conventional crushers, the arm support supporting the arms is rotatably mounted on a bracket to be attached to a construction machine, and the opening and closing direction of the arms; is determined by making one arm strike a fixed object to give a force to the whole crusher and rotate the arm support with respect to the attachment bracket. Namely, the crusher is rotated by striking the fixed object in order to determine the direction of opening and closing of the arms.

For the rotation of the crusher by striking, it is desirable that the rotation resistance is small so that the arm support is smoothly rotate with respect to the attachment bracket. On the other hand, if the arm support is easily turned to change the opening and closing direction of the arms after determining the direction, the working efficiency is made poor. Specifically, in crushing a building structure, the crusher is moved so that the building structure is positioned at a center of the opened arms. At that time, since the arms are opened, a large moment acts on the arm support about its axis of rotation due to the eccentric weight of the arms, so that the arm support rotates by itself if the rotation resistance is small. If the arms rotate to change its opening and closing direction from horizontal to vertical directions although the arms have been opened horizontally, it would be impossible to crush a vertical building structure, such as a column or a wall.

DISCLOSURE OF INVENTION

An object of the present invention is to overcome the foregoing disadvantages of the conventional art, to provide a crusher which is capable of efficiently performing the above-mentioned works (1)–(5) without changing the crusher and preventing arms from rotating by themselves.

A crusher of the present invention comprises: a bracket adapted to be attached to a construction machine; an arm support rotatably mounted on the bracket; a pair of arms, each pivotally supported at its central portion on the arm support, for squashing the object by opening and closing actions, each of the pair of arms having a plurality of through holes between a front end thereof and the pivotally supported portion; and a hydraulic cylinder operatively connected to a rear end of each arm for driving the arms to open and close. The front end of each arm is divided into a plurality of fingers each having a claw, a central one of the claws of one of the arms is more inwardly inclined to the pivotally supported portion of one arm than the remaining claws, and the arm support and the arms are balanced in weight with respect to a central axis of rotation of the arm support. With this arrangement, the arm support is prevented from rotating by itself with respect to the attachment bracket in dependence upon the posture of the crusher. Particularly, the weight of the crusher can be balanced by making the arms substantially identical in length, width and thickness with each other. A shearing blade is fixed to each arm in the vicinity of the pivotally supported portion for cutting the object. Preferably, at least one additional claw may be fixed to one or both arms at a position between the front end thereof and the pivotally supported portion for smashing the object into pieces.

For crushing of a concrete building structure such as a column, a wall and a base, the arm support is rotated by striking it against a fixed object so that the opening and closing direction of the arms is substantially perpendicular to the extending direction of the building structure, and then the hydraulic cylinder is driven to open the front ends of the arms and the arms is positioned to clamp the object, such as a column or a beam, between the claws of the pair of arms. At that time, since the crusher is balanced in weight with respect to the center of rotation of the arm support, the crusher can be moved keeping the same open posture of the arms, without any rotation of the arm support. With the object to be crushed positioned centrally between the opened arms, the front ends of the arms are closed. The central claw fixed to be directed more inwardly than the other claws on one arm is first strike the object. The entire front ends of the other arm strike the object. When the arms are further closed, the central claw gives a concentrated force on the object of the concrete building structure to cause cracks in the object. When the arms are still further closed, the plural claws at the front ends of the two arms compress the building structure to squash over a wide range. Namely, a concentrated stress is given by the inwardly directed central claw to the object to cause cracks, so that the object being made fragile is squashed by all the claws at the front ends of the arms. Especially, the building structure can be squashed over a wide range by making the width of two arms substantially equal to each other.

The iron reinforcing rods and iron frames, which are exposed by squashing the concrete building structure, are cut by the shearing blades. The scraps of the concrete building structure are scooped by one arm and smashed into pieces by closing the pair of arms. The smashed scrap pieces flow out from the through holes formed in the central portions of the arms. At that time, the concrete scraps are broken into pieces smaller than the size of the through holes, so that the smashed concrete pieces of a substantially uniform size are obtained. Especially, by providing additional claws for smashing the scrap at the central portions of the arms, relatively large scraps can be smashed with a concentrated stress given by the additional claws. In destroying a wooden house, columns, beams and walls of the house can be cut and broken by squashing with the arms.

The crushed iron reinforcing rods, wooden columns and beams, etc. which are relatively long, are collected in a pile by the claws at the front ends of the arms and are then grasped and carried onto the bed of a truck by the pair of arms. In this case, as the width of the arms is made relatively large, long pieces can be grasped and carried stably, to thereby perform the operation at high efficiency.

BEST MODE FOR CARRYING OUT THE INVENTION

Figure 1:
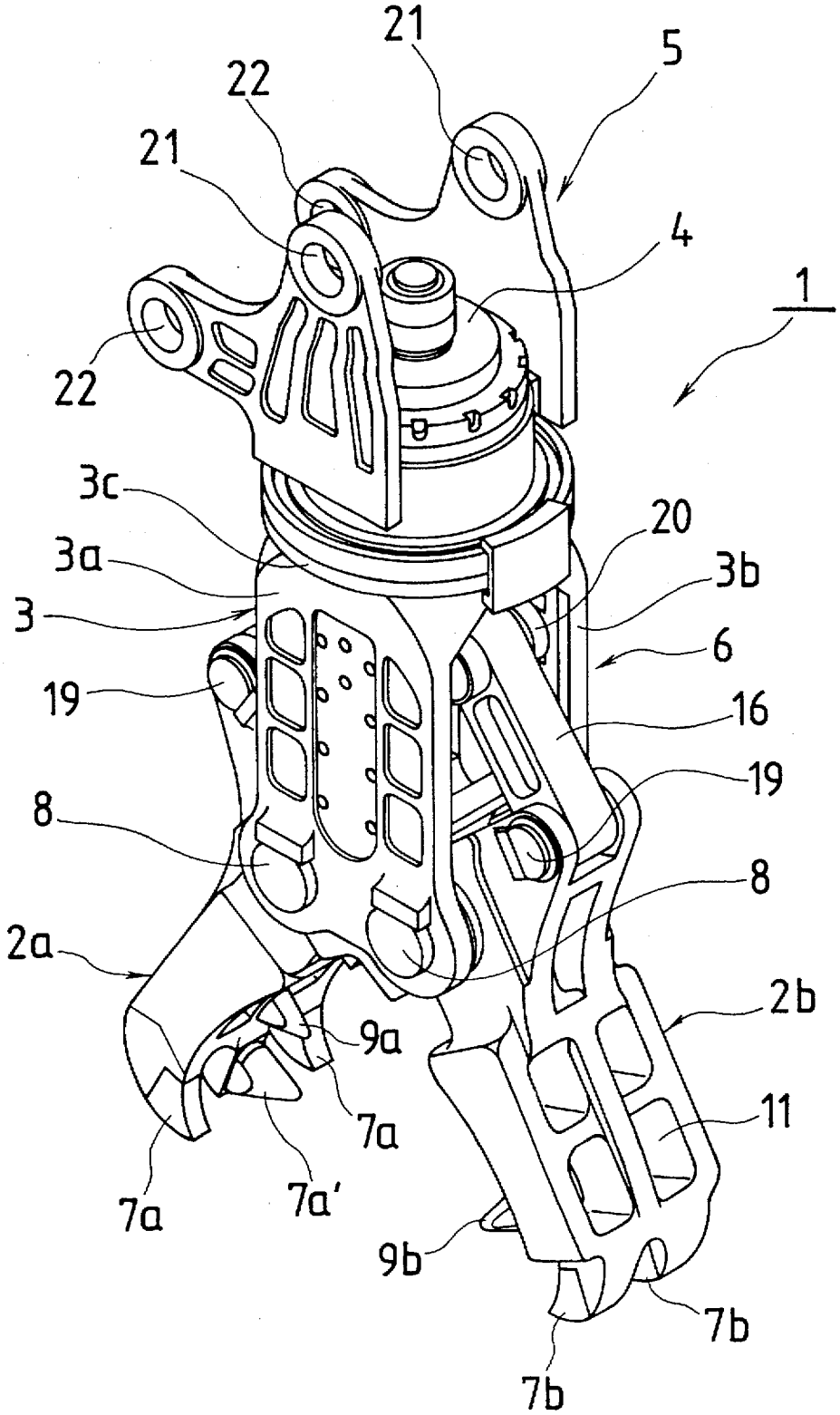
FIG. 1 is a perspective view of a crusher according to one embodiment of the present invention.
Figure 2:
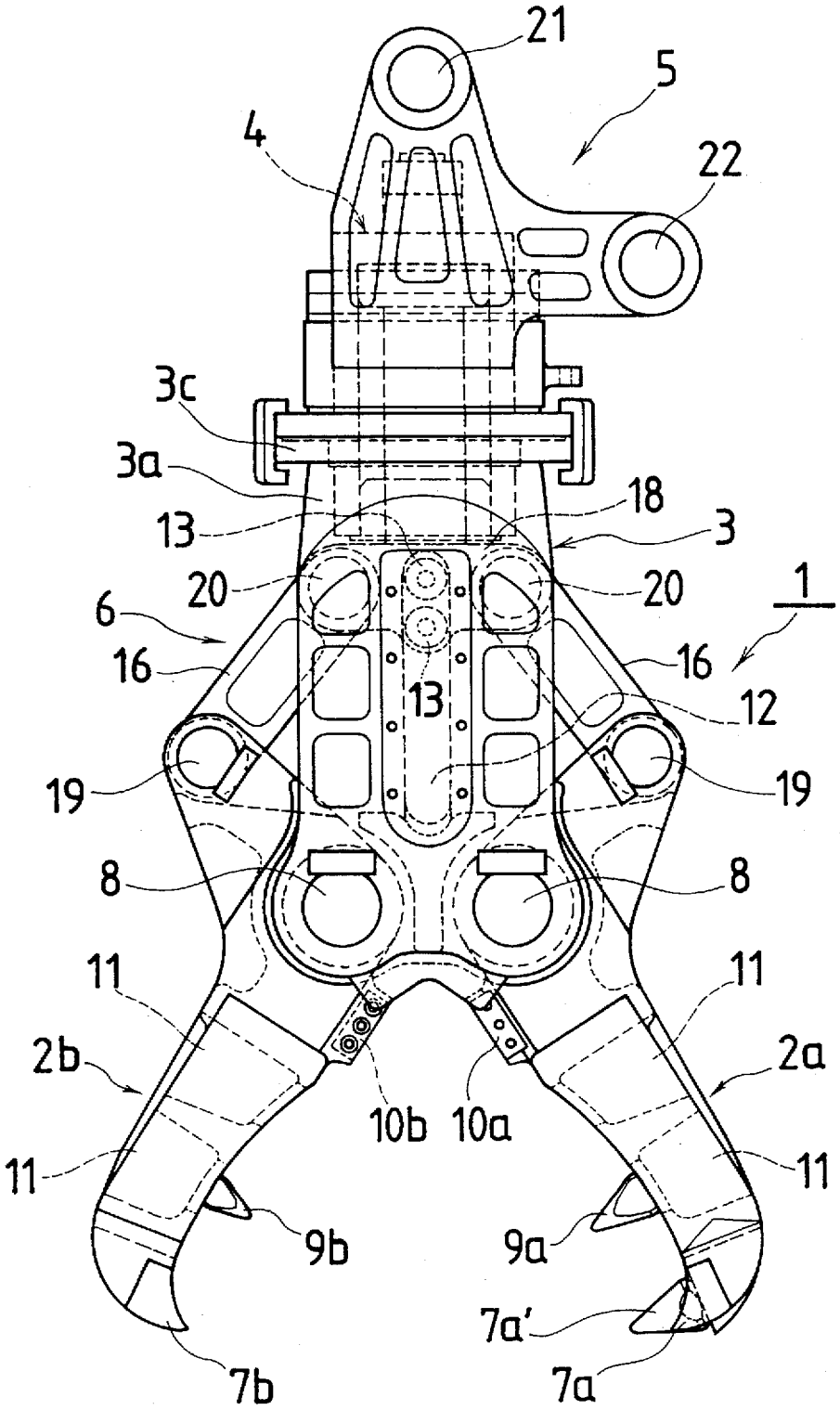
FIG. 2 is a front view of the crusher shown in FIG. 1, with arms in open position.
Figure 3:
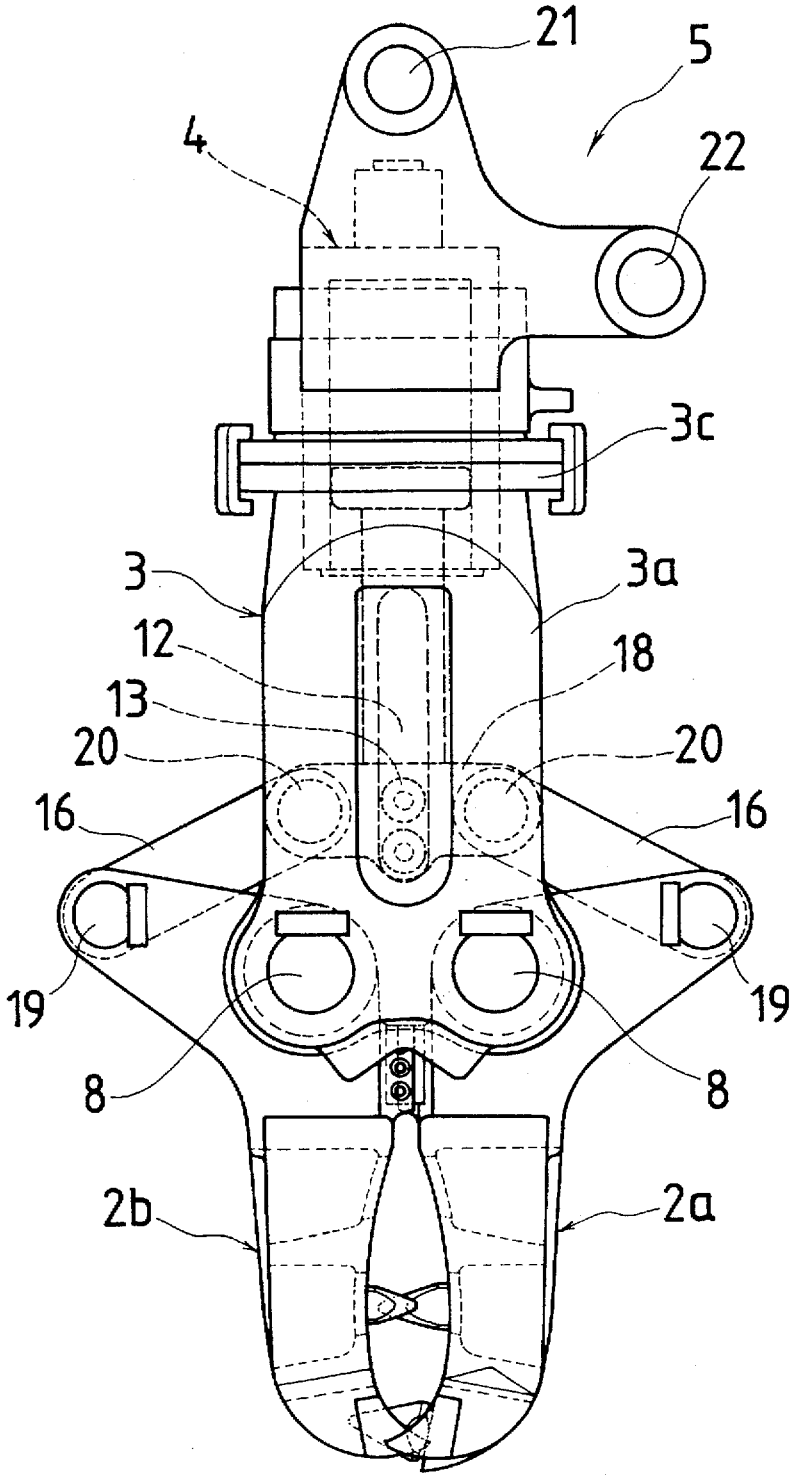
FIG. 3 is a front view of the crusher shown in FIG. 1, with the arms in closed position.
Figure 4A:
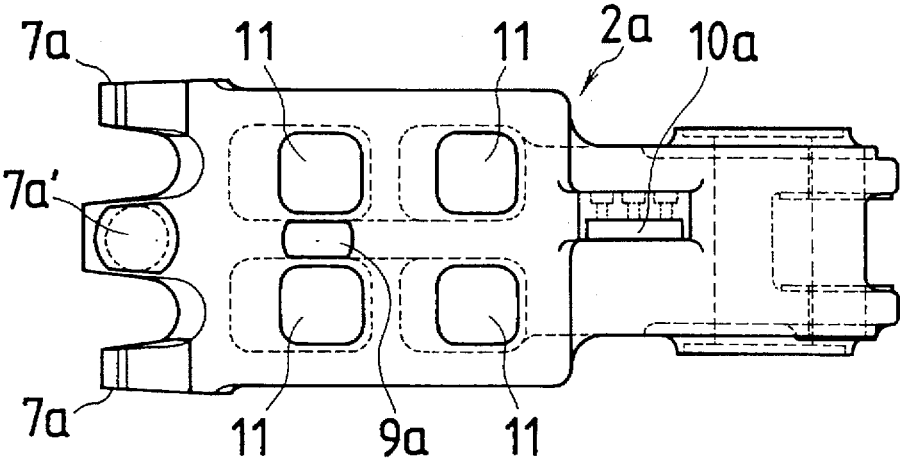
FIG. 4*a* is an elevational view of one arm of the crusher shown in FIG. 1, as viewed from the side of a crushing surface (a surface of grasping a building structure)
Figure 4B:
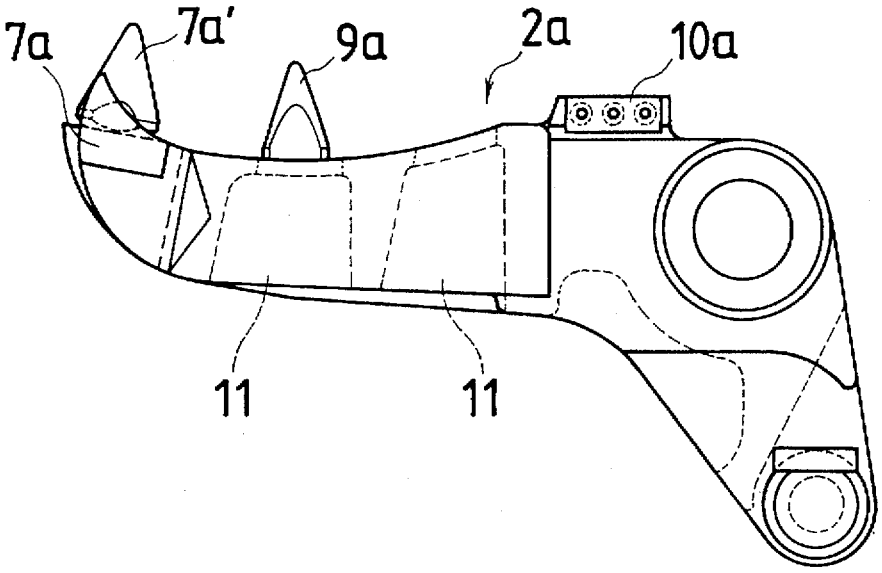
FIG. 4*b* is a side view of the arm.
Figure 4C:
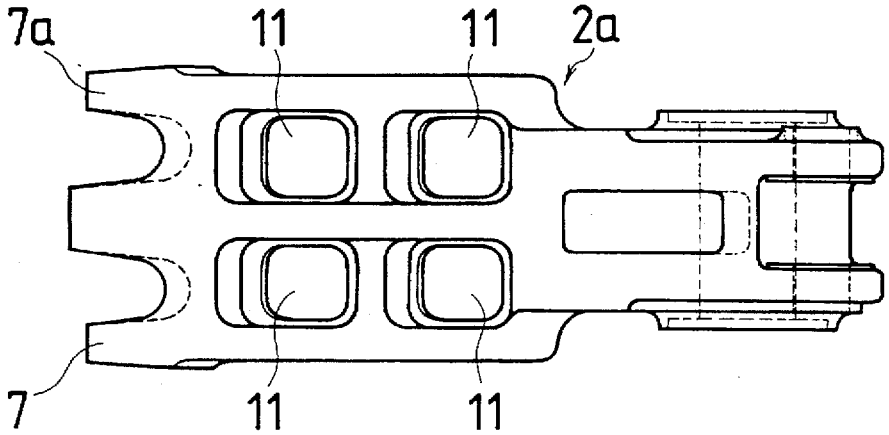
FIG. 4*c* is a rear view of the arm.
Figure 5A:
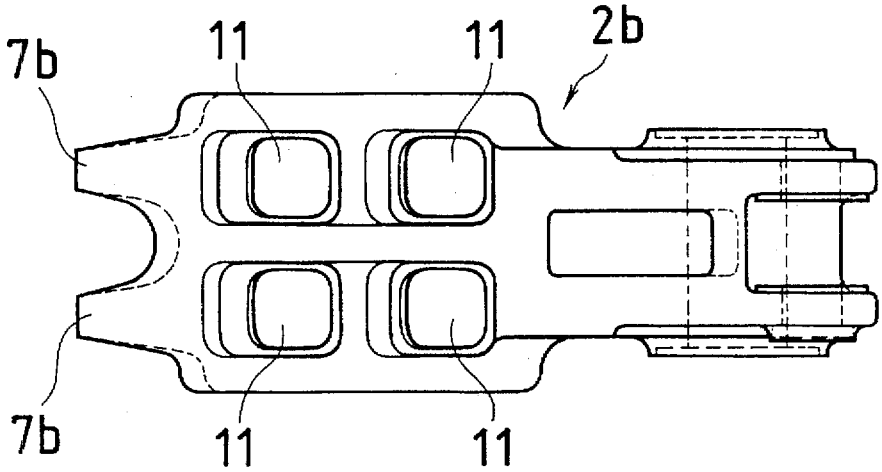
FIG. 5*a* is an elevational view of the other arm of the crusher of FIG. 1, as viewed from the side opposite to a crushing surface.
Figure 5B:
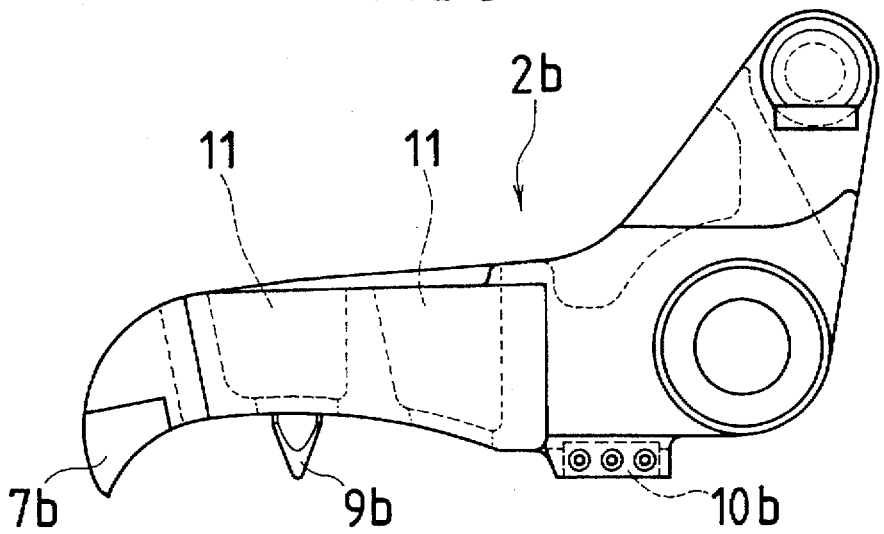
FIG. 5*b* is a side view of the other arm.
Figure 5C:
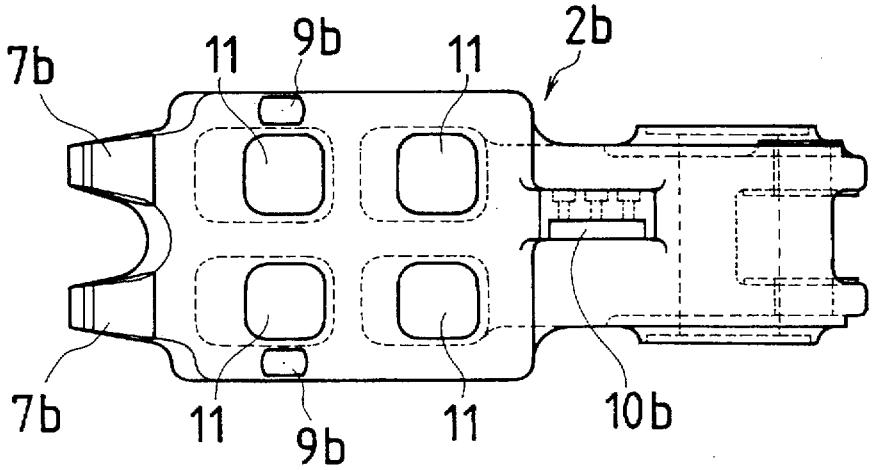
FIG. 5*c* is a rear view of the other arm.

As shown in FIGS. 1–3, a crusher 1 comprises a pair of arms 2*a* and 2*b*; an arm support 3 having side plates 3*a*, 3*b* and an annular flange 3c connecting these side plates 2*a*, 3*b*; a hydraulic cylinder 4; an attachment bracket 5 to be attached to a construction machine; and a linkage mechanism 6 as driving power transmitting means. The pair of arms 2*a* and 2*b* are formed to be a substantially L-shaped hook and each pivotally supported at its central portion on the arm support 3 by a pin 8. Each of arms 2*a* and 2*b* is divided at its front end portion into a plurality of fingers to which a plurality of crushing claw 7*a*, 7*a'*, 7*b* are respectively attached. The front end portion of one arm 2*a* is divided into three fingers to which three claws 7*a*, 7*a'*are respectively fixed by welding or other means, the central one 7*a'*of the three claws being directed differently from the remaining claws 7*a*. Specifically, only the central claw 7*a'*is fixed so that its tip is directed inwardly, i.e., to be more inclined toward the pivoted portion of the arm than the remaining claws 7*a*. The front end portion of the other arm 2*b* is divided into two fingers to which two claws 7*b* similar to the claws 7*a* are respectively fixed by welding or other means. Thus, only the tip of the claw 7*a'*is directed inwardly with respect to the remaining claws 7*a*, 7*b*.

Each of the arms 2*a* and 2*b* has four through holes 11 in a region between the portion pivoted by the pin 8 and the front end portion. A diameter of each through hole 11 increases from the inside of the arm (the side of the squashing surface) toward the outside (FIGS. 4*a*–4*c* and 5*a*–5*c*).

To the arm 2*a*, a smashing claw 9*a* is fixed at an intermediate position between the portion pivoted by pin 8 and the front end portion by welding or other means. To the other arm 2*b*, smashing claws 9*b* are fixed at all intermediate portion between the portion pivoted by the pin 8 and the front end portion by welding or other means.

Further, to proximal portions of the two arms 2*a* and 2*b* near the pivoted portions, two shearing blades 10*a* and 10*b* for cutting iron reinforcing rods, iron frame, etc. are respectively attached.

The two arms 2*a* and 2*b* are substantially identical in length, width and thickness with each other, as shown in FIGS. 4 and 5, and have substantially the same weight. Further, since the side plates 3*a* and 3*b* of the arm support 3 also have the same shape, the whole body of the crusher is substantially balanced in weight with respect to the center line in FIGS. 2 and 3, i.e. the central axis of rotation of the arm support 3.

As shown in FIGS. 1–3, the arm support 3 is rotatably connected to the attachment bracket 5 via the annular flange 3*c*, which is a part of the arm support 3*c*. The rear end portions of the arms 2*a* and 2*b* are connected to a piston rod of the hydraulic cylinder 4 via the linkage mechanism 6, which are composed of a link member 18, connecting levers 16 pivotally connected to opposite ends of the link member 18, pivot pins 19 and 20, etc., so that the front end portions of the arms 2a and 2b are driven to be opened and closed in response to the back and forth motion of the piston rod. Rollers 13 are attached to the link member 18 connected to the piston rod of the hydraulic cylinder 4 for guiding the piston rod along a guide groove 12 formed in the arm support 3. Attachment holes 21, 22 are used for attaching the crusher 1 to a distal end of a boom of the construction machine. The crusher 1 is pivotally supported by the distal end of the boom of the construction machine via one pair of attachment holes 21, and is angularly moved to a desirable angular position about the attachment holes 21 by back and forth motion of an actuator of the construction machine which is pivotally attached to the other pair of attachment holes 22.

For wrecking a concrete building structure using the crusher 1 of this embodiment, one of the arms 2a and 2b is pressed against a fixed object and the arm support 3 is turned with respect to the attachment bracket 5 to determine an angular position of the arm support 3 so that the arms 2a and 2b can clamp a building structure, such as a concrete wall or column, in a direction substantially perpendicularly to an extending direction of the building structure. At that time, since the crusher has a balanced structure in weight with respect to the central axis of turning of the arm support 3, the arm support 3 can keep its posture with the arms 2a and 2b opened, without any an angular moment caused by the weight of the arms (or with a negligibly small angular moment smaller than the turning resistance between the arm support 3 and the attachment bracket 5), even if the arms 2a and 2b are moved to open horizontally.

Then, the building structure is clamped between the claws 7a, 7a'at the front end of the arm 2a and the claw 7b at the front end of the arm 2b, to carry out the crushing work. Since each of the arms 2a and 2b is curved in a hook shape, only the tips of the claws 7a, 7a'and 7b catch the building structure even when the arms 2a and 2b are opened widely to clamp the building structure.

Specially, since the claw 7a'attached centrally to the front end portion of the arm 2a is directed more inwardly than the remaining claws 7a and is disposed nearer the squashing surface of the other arm 2b than the remaining claws 7a, the central claw 7a'of the arm 2a strikes the building structure earlier than the remaining claws 7a when the arms 2a and 2b are closed. In the meantime, the claw 7b, the front end portion near the claw 7b, or the claw 9b of the other arm 2b strikes the building structure. When the arms 2a and 2b are further closed, since only the central claw 7a'of the arm 2a strikes the building structure and clamps the structure under pressure cooperatively with the other arm 2b, a concentrated stress is added to the building structure at the position struck by the central claw 7a', from which a crack occurs in the concrete building structure to make the structure fragile. With the arms 2a and 2b further closed, all of the claws 7a, 7a'and 7b strike the building structure to increase an area clamping the structure, but the clamped portion which has made fragile because of the crack is easily squashed.

Thus, a strong clamping force is concentrated on the concrete building structure by the central claw 7a'. First, the central claw causes a crack in the building structure to make the structure fragile and then all of the claws clamp the fragile structure to squash it widely (corresponding to the width of the two arms).

After the concrete building structure is thus squashed, the exposed iron reinforcing rods and frames are cut out by the shearing blades 10a and 10b to crush the building structure completely.

The resulting concrete scraps are scooped by the opened arms 2a and 2b and are then smashed into smaller pieces. Because of the large width of the arms 2a and 2b, the arms can scoop the concrete scraps smoothly. After scooping the concrete scraps, the arms are closed to clamp the scooped scraps in a manner that they are hold between the arms. The clamped concrete scraps flow out through the through holes 11 and smashed into pieces smaller than the through holes 11. Specifically, if the concrete scrap is large in size, it may be clamped and squashed by the claws 7a, 7a', 7b , and if the scrap is of such size that can be clamped between the squashing surfaces of the two arms 2a and 2b, the claws 9a, 9b disposed centrally of the front portion of the arm 2a first strike the scrap to give a concentrated force thereto, so that the scrap can be squashed easily. Since the claws 9a, 9b are disposed closer from the pivot pins 8 than the claws 7a, 7a', 7b, a greater crushing force is produced than the claws 7a, 7a', 7b. Therefore, the concrete scrap can be simply smashed by the claws 9a, 9b. By smashing the concrete scraps into pieces smaller than a predetermined size in the above manner, it is possible to realize recycling.

Unless the column, wall or beam of the concrete building structure is so large, the structure may be crushed by clamping and compressing the building structure by the claw 7a'and the claws 9a, 9b.

When crushing a wooden house, since a large destroying force is not required, it is possible to crush the house only by grasping and compressing a column, a beam or a wall between the squashing surfaces of the two arms 2a and 2b (the inner confronting surfaces of the arms 2a and 2b ).

Further, since the front end portions of the arms 2a and 2b are divided in a fork shape and are large in width, elongated scraps, such as columns, beams, iron reinforcing rods and iron frames, which are dropped on the ground when the building structure is wrecked, can be collected at a high efficiency by opening the arms 2a and 2b and moving the claws 7a, 7b of the front end portions of the arms 2a and 2b along the ground surface.

When the elongated scraps, such as columns, beams, iron reinforcing rods and iron frames, collected in pile are to be moved to another place or loaded on the bed of a truck, these elongated scraps are grasped and carried by the two arms 2a and 2b, and then released from the arms 2a and 2b. Especially since the arms 2a and 2b have large and substantially the same width, the elongated scraps can be grasped and carried stably.

In the foregoing embodiment, the central claws 9a and 9b are provided on both arms 2a and 2b at their front portions, respectively. Alternatively, a central claw or claws are provided only on one arm. Further, in the foregoing embodiment, the through holes 11 are disposed at substantially the same positions in the confronting surfaces of the arms. Alternatively, the through holes 11 of one arm may be out of alignment with those of the other arm at all or may be only partly in alignment with those of the other arm.

Further, if the output of the hydraulic cylinder is large, a plurality of claws 7a', which are directed inwardly of the remaining claws 7a, may be provided.

The crusher of the present invention has the following advantageous effects.

(1) As the claw disposed centrally at the front end of one arm is directed inwardly of the remaining claws, the central claw first strikes the concrete building structure and gives a squashing pressure to the structure, when clamping the building structure between the arms. Thus, the squashing force acts on the building structure with great concentration about the central claw, so that a crack or fissure is caused in the building structure by the concentrated stress to make the building structure fragile and easy to destroy. It is therefore possible to destroy a concrete column or beam having a large diameter.

(2) As the concrete building structure is first made fragile when destroying it, it is possible to squash the building structure in subsequent clamping with increased clamping width of the arms. Thus, the building structure is squashed widely by clamping of the plural claws at the front end portions of the arms. As the building structure can be squashed widely at a single opening-and-closing action of the arms, the efficiency of the crushing work is improved.

(3) As the weight of the crusher is balanced with respect to the central axis of rotation of the arm support, a possible angular moment acting on the arm support is so small that it does not turn the arm support when moving the crusher with the arms opened so as to clamp the building structure to be crushed. Therefore, even if the arms are opened substantially horizontally, it is possible to move the crusher while keeping the horizontal posture.

(4) As the through holes are provided on the arms centrally in the front portion (squashing surfaces), it is possible to smash the concrete scraps, which are produced by destroying of the concrete building structure, into small pieces by clamping and compressing them between the squashing surfaces.

(5) As the front end portion of the arm is divided in a fork shape and the central portion (squashing surface) of the arm has a relatively large area, a large amount of concrete scraps can be scooped at one time in performing the above-mentioned smashing of the scraps and hence the efficiency of the smashing is made high.

(6) As the front end portion of each arm is divided in a fork shape, elongated scraps, such as columns, beams, iron reinforcing rods and iron frames, are easily collected by moving the claws provided on the fork-shaped front end of the arms along the ground surface.

(7) As the arms have the same width, which is larger than that of the conventional crusher, the collected elongated scraps can be stably grasped in carrying them and thus loading of the elongated scraps onto a truck can be facilitated.

(8) When one or more claws is provided on one arm centrally at the front portion, the concrete scraps can be smashed into small pieces more efficiently.

I claim:

1. A crusher for crushing and shearing an object, comprising:

a bracket adapted to be attached to a construction machine;

an arm support rotatably mounted on said bracket;

a pair of arms, each pivotally supported at its central portion on said arm support, for squashing the object by opening and closing actions, each of said pair of arms having a plurality of through holes between a front end thereof and said pivotally supported portion; and a hydraulic cylinder operatively connected to a rear end of each of said pair of arms for driving said arms to open and close;

wherein said front end of each of said pair of arms is divided into a plurality of fingers each having a claw, a central one of said claws of one of said arms is more inwardly inclined to said pivotally supported portion of said one arm than the remaining claws, and said arm support and said pair of arms are balanced in weight with respect to a central axis of rotation of said arm support.

2. A crusher according to claim 1, wherein each of said pair of arms has a shearing blade fixed in the vicinity of said pivotally supported portion for cutting the object.

3. A crusher according to claim 1, wherein at least one of said pair of arms has at least one additional claw fixed at a position between said front end and said pivotally supported portion for smashing the object into pieces.

4. A crusher according to claim 1, wherein said pair of arms are substantially identical in length, width and thickness with each other.

5. A crusher according to claim 4, wherein each of said pair of arms has a shearing blade fixed in the vicinity of said pivotally supported portion for cutting the object.

6. A crusher according to claim 4, wherein at least one of said pair of arms has at least one additional claw fixed at a position between said front end and said pivotally supported portion for smashing the object into pieces.

* * * * *